US009056349B2

(12) United States Patent
Katsuyama et al.

(10) Patent No.: US 9,056,349 B2
(45) Date of Patent: Jun. 16, 2015

(54) COIL-SPRING MANUFACTURING APPARATUS

(71) Applicant: NHK Spring Co., Ltd., Yokohama-shi, Kanagawa (JP)

(72) Inventors: Akira Katsuyama, Yokohama (JP); Takayuki Morishima, Yokohama (JP); Takashi Yajima, Yokohama (JP); Yuji Mori, Yokohama (JP); Kotaro Nukui, Yokohama (JP)

(73) Assignee: NHK SPRING CO., LTD., Yokohama-shi, Kanagawa (JP)

( * ) Notice: Subject to any disclaimer, the term of this patent is extended or adjusted under 35 U.S.C. 154(b) by 190 days.

(21) Appl. No.: 13/750,039

(22) Filed: Jan. 25, 2013

(65) Prior Publication Data

US 2013/0133391 A1 May 30, 2013

Related U.S. Application Data

(63) Continuation of application No. PCT/JP2011/067362, filed on Jul. 28, 2011.

(30) Foreign Application Priority Data

Jul. 30, 2010 (JP) ..... 2010-172670

(51) Int. Cl.
*B21F 3/02* (2006.01)
*B21F 35/00* (2006.01)

(52) U.S. Cl.
CPC .. *B21F 3/02* (2013.01); *B21F 35/00* (2013.01)

(58) Field of Classification Search
CPC ..... B21F 3/00; B21F 3/02; B21F 35/00; B21B 2015/0057
USPC ..... 72/135, 138
See application file for complete search history.

(56) References Cited

U.S. PATENT DOCUMENTS 4,444,036 A 4/1984 Shibata et al.
2002/0104353 A1 8/2002 Hresc et al.

FOREIGN PATENT DOCUMENTS

JP 57-25233 A 2/1982

(Continued)

OTHER PUBLICATIONS

International Preliminary Report on Patentability (IPRP) dated Feb. 14, 2013 (in English) issued in parent International Application No. PCT/JP2011/067362.

(Continued)

*Primary Examiner* — Teresa M Ekiert
(74) *Attorney, Agent, or Firm* — Holtz, Holtz, Goodman & Chick PC

(57) ABSTRACT

A coil wire material is bent by a first roll, a second roll, and a third roll. The bent coil wire material is pressed in a screwing direction, to shape a coil spring having a desired diameter and a pitch. A desired pitch can be accurately formed in a manner that a second roll provided on a downstream side of a conveying direction of the coil wire material is configured to be able to move hack and forth along the screwing direction of the coil spring and to be tiltable about an axis of rotation parallel to the conveying direction of the coil wire material.

3 Claims, 5 Drawing Sheets

(56) References Cited

FOREIGN PATENT DOCUMENTS

| | | | |
|---|---|---|---|
| JP | 2-200331 | A | 8/1990 |
| JP | 06081649 | B2 | 10/1994 |
| JP | 9-136130 | A | 5/1997 |
| JP | 9-136131 | A | 5/1997 |
| JP | 2002-143963 | A | 5/2002 |

OTHER PUBLICATIONS

International Search Report dated Nov. 1, 2011 (in English) in counterpart International Application No. PCT/JP2011/067362.

Korean Office Action dated May 16, 2014 in counterpart Korean Application No. 10-2013-7002433.

Japanese Office Action dated Mar. 25, 2014 (and English translation thereof) in counterpart Japanese Application No. 2010-172670.

COIL-SPRING MANUFACTURING APPARATUS

CROSS REFERENCE TO RELATED APPLICATIONS

This application is a Continuation Application of PCT Application No. PCT/JP2011/067362, filed Jul. 28, 2011 and based upon and claiming the benefit of priority from prior Japanese Patent Application No. 2010-172670, filed Jul. 30, 2010, the entire contents of all of which are incorporated herein by reference.

BACKGROUND OF THE INVENTION

1. Field of the Invention

The present invention relates to a coil-spring manufacturing apparatus which manufactures a coil spring by bending a coil wire material with at least three rolls and by simultaneously applying a pitch to the material with a pitch tool.

2. Description of the Related Art

A coil-spring manufacturing machine using rolls is configured, as described in Jpn. Pat. Appln. KOKAI Publication No. 57-25233, in a manner that two shaping rolls are provided along a conveying direction of a coil wire material on one side of the conveying direction and that a supporting roll is positioned so as to face the two shaping rolls between the two shaping rolls, on the other side of the conveying direction. That is, with reference to the conveying direction of the coil wire material, the two shaping rolls and the one supporting roll are provided respectively on one side and the other side. The supporting roll is movable in up and down directions. The two shaping rolls are arranged bilaterally symmetrical about the supporting roll as a center, and the two shaping rolls are also bilaterally symmetrically movable. Further, a pitch tool which can be moved back and forth along a screwing direction is provided in a lower part of each of these rolls.

The coil-spring manufacturing machine manufactures a coil spring having an arbitrary outer diameter and an arbitrary pitch in a manner that: a spring outer diameter of a coil spring to shape is set by an interval between the two shaping rolls and an increase amount of the supporting roll; a coil wire material is made penetrate among three rolls, positions of which are properly set, to thereby bend and shape the coil wire material; and the bent coil wire material is properly pressed in a screwing direction of the coil spring by the pitch tool, to thereby shape a predetermined pitch.

Recently, a coil spring having a great pitch change is demanded. For example, to manufacture a coil spring which has an increased pitch at a center part in an axis direction of the coil spring, the coil spring is shaped to have a small pitch at the start of winding, which is then increased. At a position beyond a part having the greatest pitch, the pitch needs to be decreased again.

BRIEF SUMMARY OF THE INVENTION

However, even after the pitch of a coil spring is reduced to be small, a coil wire material may come apart from the pitch tool and sometimes cannot follow movement of the pitch-tool. As the pitch tool is greatly pushed out in a screwing direction of the coil spring, the pitch tool pushes cut the coil wire material and can thus easily increase the pitch. However, even if the pitch tool is abruptly moved back, shaping at a predetermined pitch cannot be achieved unless the coil wire material follows backward movement of the pitch tool. Therefore, a conventional manufacturing apparatus which uses rolls has problems that the pitch changes greatly and abruptly decreases and that a coil spring having a negative pitch is difficult to shape accurately.

The invention hence has an object of providing a coil-spring manufacturing apparatus which can steadily shape a coil spring having a desired pitch.

To solve the above problems, a coil-spring manufacturing apparatus according to the invention is configured as follows.

The coil-spring manufacturing apparatus comprises a first roll (shaping roll) and a second roll (shaping roll) arranged on a side of a conveying direction of a coil wire material, along the conveying direction, and a third roll (support roll) arranged between the first and second rolls opposed to the first and second rolls. Further, the coil-spring manufacturing apparatus comprises a pitch tool which pushes out the coil wire material bent and shaped in a screwing direction of the coil spring to shape. The first and second rolls each can be moved along the conveying direction of the coil wire material, and the third roll can be moved in a direction which vertically intersects the conveying direction of the coil wire material.

Further, the second roll provided in a downstream side along the conveying direction of the coil wire material is movable along a screwing direction of the coil spring to shape by a first rotary drive apparatus, and is tiltable about, as an axis of rotation, an axial line parallel to the conveying direction of the coil wire material by a second rotary drive apparatus.

The coil-spring manufacturing apparatus according to the invention has effects as follows.

By the first to third rolls, the coil wire material is bent in a circumferential direction of the coil spring, and a pitch is formed by the pitch tool. In addition, the second roll is moved back and forth along the screwing direction of the coil spring to be shaped. The second roll can thus be shifted along the screwing direction of the coil spring in relation to the second roll. In this manner, a deformation force to shape the coil, wire material at a pitch can be applied by the second and third rolls.

Accordingly, to reduce the pitch of the coil spring to shape, a force in a direction of reducing the pitch can be applied by moving back the second roll. In this manner, even a coil spring whose pitch greatly changes or particularly a coil spring having a shape whose pitch greatly decreases can be formed in a desired shape.

In addition, by tilting about, as an axis of rotation, the axial line parallel to the conveying direction of the coil wire material, in accordance with a difference in coil screwing direction between the second and third rolls, and in accordance with the direction of the force applied to the coil wire material, the coil wire material can be grasped from a predetermined direction by the second roll and the third roll, and the coil spring can be steadily shaped at a desired pitch.

DETAILED DESCRIPTION OF THE INVENTION

Figure 1:
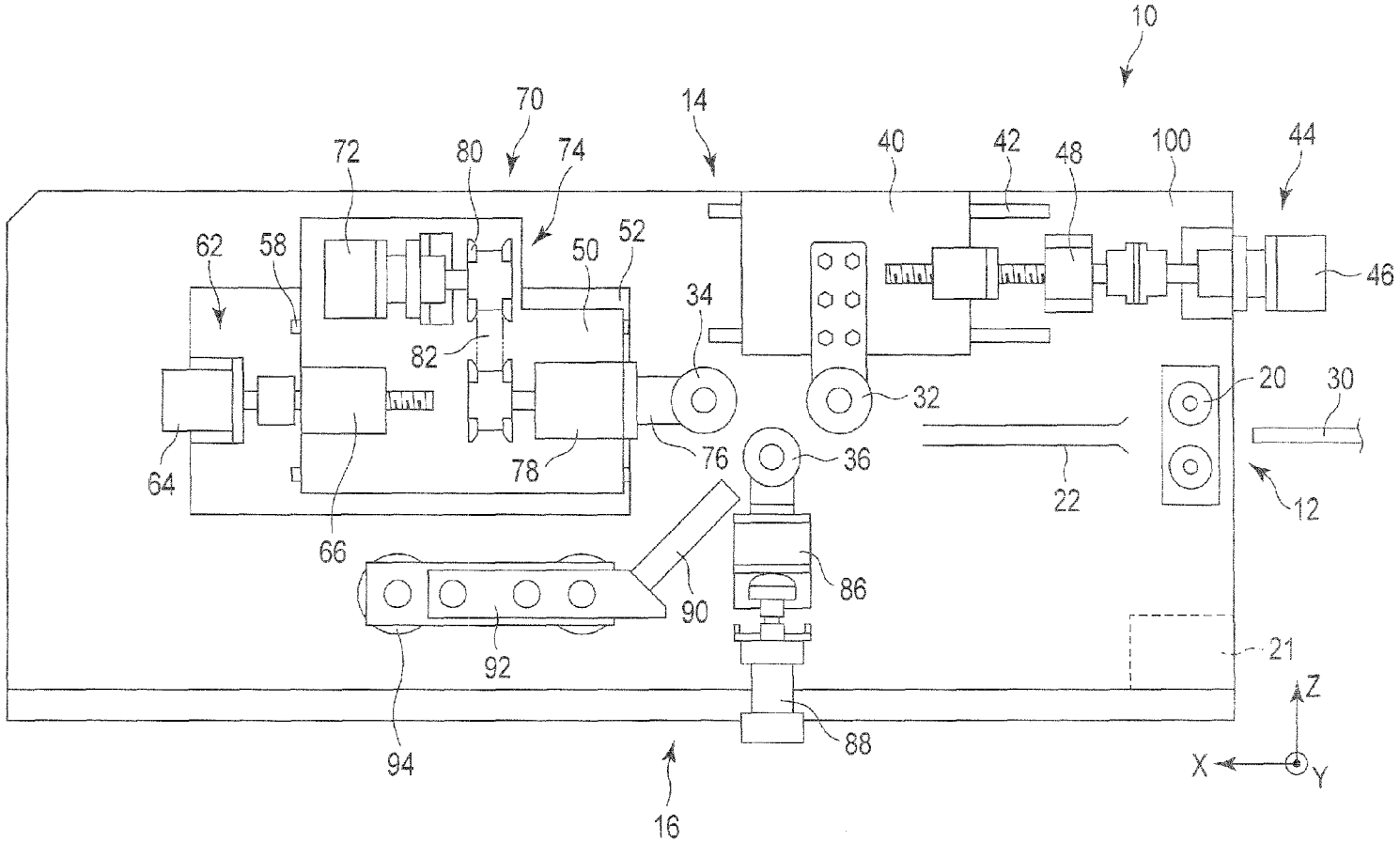
FIG. 1 is a front view showing a coil-spring manufacturing apparatus according to an embodiment of the invention.
Figure 2:
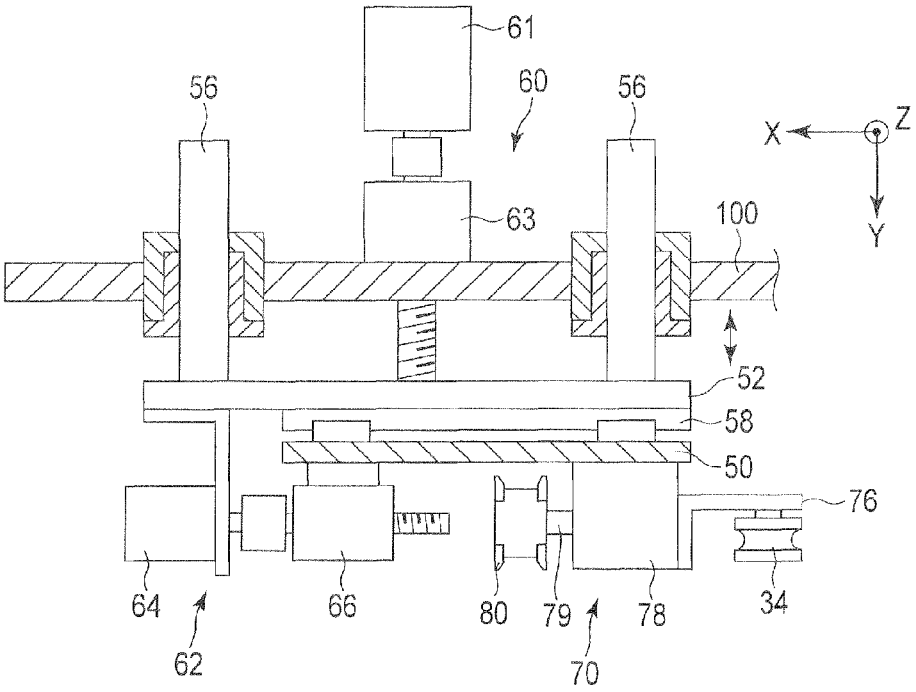
FIG. 2 is a plan view showing a main part of the coil-spring manufacturing apparatus.
Figure 3:
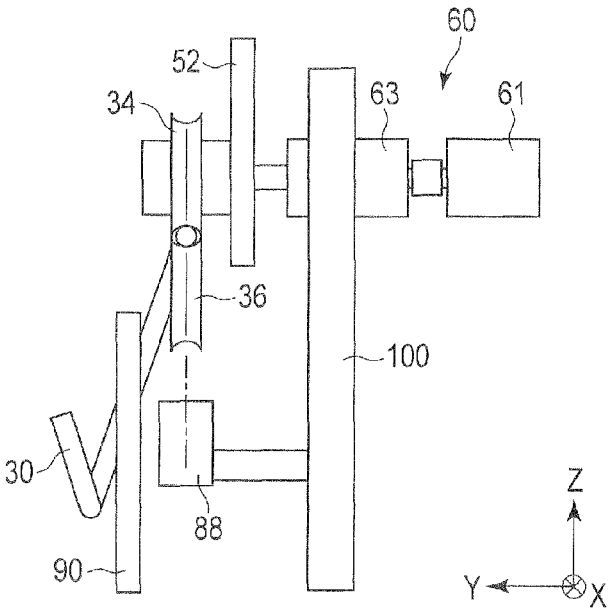
FIG. 3 shows a configuration of a layout of rolls incorporated in the coil-spring manufacturing apparatus.
Figure 4:
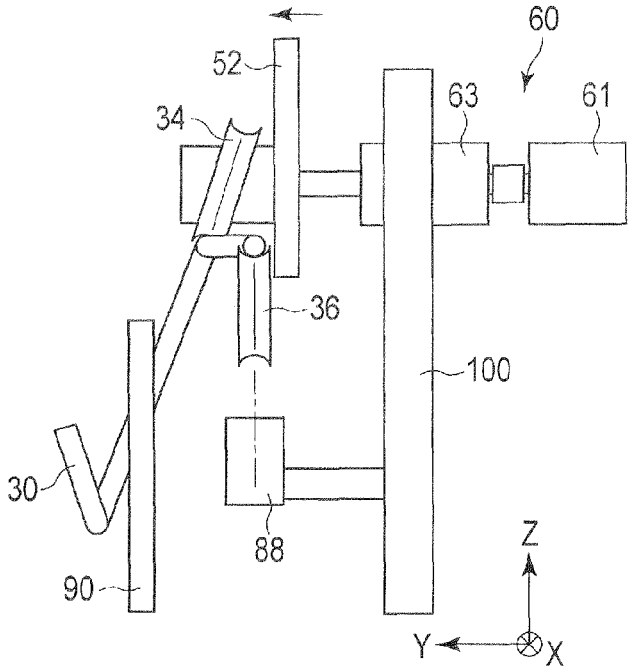
FIG. 4 shows a configuration of a layout of the rolls.
Figure 5:
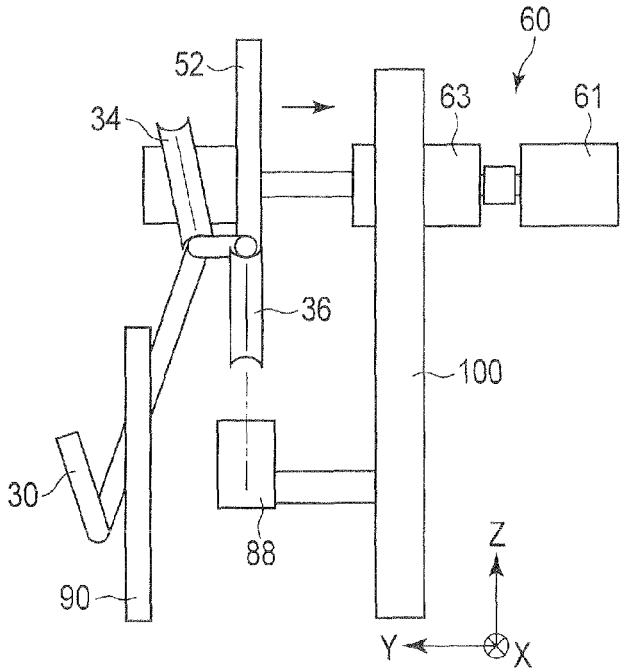
FIG. 5 shows a configuration of a layout of the rolls.
Figure 6:
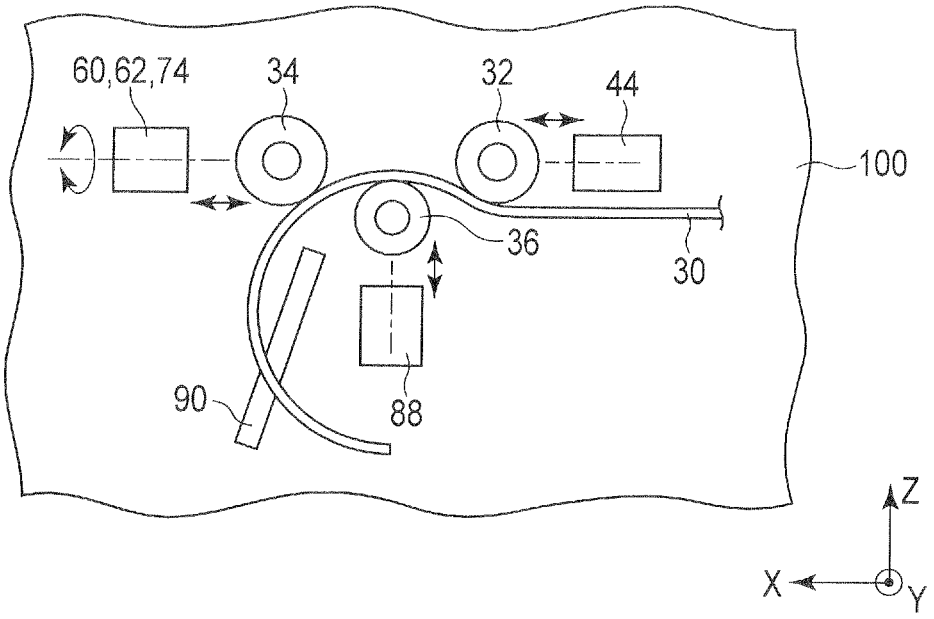
FIG. 6 shows a schematic configuration of the coil-spring manufacturing apparatus.
Figure 7:
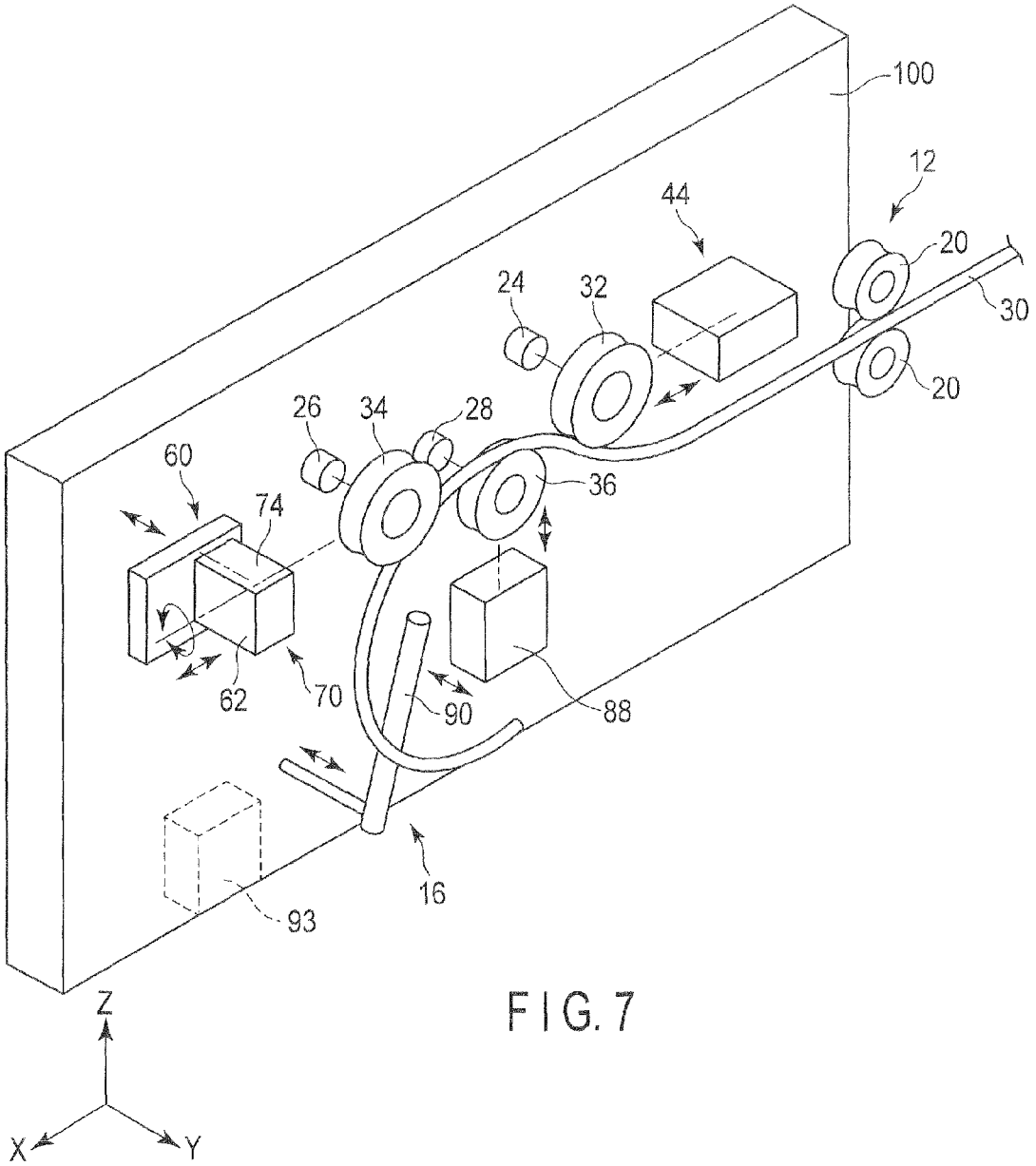
FIG. 7 is a perspective view showing a schematic configuration of the coil-spring manufacturing apparatus.

FIG. 1 is a front view showing a coil-spring manufacturing apparatus 10 according to an embodiment of the invention. FIG. 2 is a plan view showing a main part of the coil-spring manufacturing apparatus 10. FIG. 3 shows a configuration of a layout of rolls incorporated in the coil-spring manufacturing apparatus 10. FIG. 4 shows a configuration of a layout of the rolls. FIG. 5 shows a configuration of a layout of the rolls. FIG. 6 shows a schematic configuration of the coil-spring manufacturing apparatus 10. FIG. 7 is a perspective view showing a schematic configuration of the coil-spring manufacturing apparatus 10. In these figures, arrows X, Y, and Z show three directions which perpendicularly intersect each other, arrows X and Y indicate horizontal directions and arrow Z indicates a perpendicular direction.

The coil-spring manufacturing machine 10 comprises: a baseboard 100; a conveyor unit 12 which conveys a coil wire material 30; a curvature shaping unit 14 which bends the coil wire material 30 fed out of the conveyor unit 12; and a pitch shaping unit 16 which applies a pitch to the coil wire material 30 subjected to a bending process by the curvature shaping unit 14.

The baseboard 100 is a plate-like member and is provided to be substantially perpendicular to a floor surface. The conveyor unit 12 is configured to comprise a pair of conveyor rolls 20 and a guide member 22. The conveyor rolls 20 are connected to a drive mechanism 21, is rotated and driven by the drive mechanism 21, and conveys the coil wire material 30 to the curvature shaping unit 14. The guide member 22 is fixed to the baseboard 100 and guides the coil wire material 30 to the curvature shaping unit 14. Generally, the coil wire material 30 is a rod-like member formed from spring steel, and has a predetermined diameter. In addition, the number of conveyor rolls 20 is not specified.

The curvature shaping unit 14 is configured to comprise a first roll 32 and a second roll 34 as the shaping rolls, and a third roll 36 as the supporting roll. The first roll 32 is provided on a first movable table 40, the second roll 34 is provided on a second movable table 50, and the third roll 36 is provided on a fourth movable table 86. The first roll 32 and second roll 34 are provided on one side in relation to a conveying path (along a conveying direction) of the coil wire material 30, and the third roll 36 is provided on the other side.

A guide rail 42 provided along the conveying direction of the coil wire material 30, and a drive mechanism 44 are attached to the baseboard 100. The first movable table 40 is provided to be movable on the guide rail 42. The drive mechanism 44 comprises a motor 46 and a feed screw mechanism 48. As the motor 46 runs, the drive mechanism 44 moves a first movable table 40 back and forth on the guide rail 42. In addition, the drive motor 24 (refer to FIG. 7) is connected to the first roll 32, and the first roll 32 is rotated and driven about a roll center as a center on the first movable table 40 with the drive motor 24.

As described above, the second roll 34 is provided on the second movable table 50. The second roll 34 is positioned in front of the first roll 32 along the conveying direction of the coil wire material 30, facing the first roll 32. The first roll 32 is a roll in an upstream side, and the second roll 34 is a roll in a downstream side.

The second movable table 50 is attached to the third movable table 52. As shown in FIG. 2, the third movable table 52 is attached to the baseboard 100 by the guide shaft 56 so as to be movable in a perpendicular direction relative to the baseboard 100. The baseboard 100 is provided with a drive mechanism 60, as a first rotary drive apparatus, which comprises a motor 61 and a feed screw mechanism 63. The drive mechanism 60 appropriately moves the third movable table 52 in a perpendicular direct relative to the baseboard 100 by running the motor 61.

As also shown FIG. 1, a guide rail 58 and drive mechanism 62 are provided on the third movable table 52. The guide rail 58 is provided along the conveying direction of the coil wire material 30. On the guide rail 58, the second movable table 50 is attached to be movable. The drive mechanism 62 comprises a motor 64 and a feed screw mechanism 66. As the motor 64 runs, the drive mechanism 62 moves the second movable table 50 back and forth on the guide rail 42 (directions along the paper surface of the figure: directions of an arrow X).

The second roll 34 is provided on the second movable able 50 through a tilt mechanism 70. The tilt mechanism 70 comprises, as a second rotary drive apparatus, a motor 72 a belt transmission mechanism 74, and a support stay 76. The support stay 76 is an L-shaped member and is provided with the second roll 34. A rotating support shaft 79 is connected to the support stay 76. The rotating support shaft 79 is held by a holder unit 78 so as to be freely movable about a center line along the conveying direction of the coil material. In addition, the second roll 34 is attached, with the width-directional center of the second roll 34 aligned with the center of the rotating support shaft 79.

A synchronous pulley 80 is attached to the other end of the rotating support shaft 79, and the motor 72 and the rotating support shaft 79 are connected to each other through a synchronous belt 82. In this way, as the motor 72 is run, the rotating support shaft 79 arbitrarily rotates and drives so as to pivot the second roll 34, centered on the width-directional center of the second roll 34. Further, a drive motor 26 (refer to FIG. 7) is attached to the second roll 34, and the second roll 34 is driven to rotate, centered on the roll center of the second roll 34. The motor 61 and the motor 72 each desirably are a servo motor capable of feedback control of operation. The synchronous belt 82 may be substituted with a chain or the like.

The third roll 36 is provided on the fourth movable table 86. On the baseboard 100, a press mechanism 88 is provided between the first roll 32 and the second roll 34. The fourth movable table 86 is appropriately movable by the press mechanism 88 in up and down directions, i.e., directions perpendicular to the conveying direction of the coil wire material 30 (directions along the paper surface of the figure: directions of arrow Z). Further, a drive motor 28 (refer to FIG. 7) is connected to the third roll 36, and the third roll 36 is driven to rotate, centered on the roll center of the third roll 36.

The pitch shaping unit 16 is provided in the front left side of the third roll 36, as shown in FIG. 7, and comprises a pitch tool 90, a base part 92, and a drive mechanism 93. The pitch tool 90 is a rod-like member and is basically positioned above, a line penetrating through the roll center of the third roll 36, with a lower end integrally fixed to the base part 92. The base part 92 is provided to be freely movable in a direction vertical to the baseboard 100 by a guide shaft 94, and is appropriately moved by the drive mechanism 93 back and forth (vertical to the paper surface of the figure: directions of arrow Y).

Next, a coil-spring manufacturing method using the coil-spring manufacturing apparatus 10 will be described.

A tip end of the coil wire material 30 is attached to the conveyor unit 12, and the coil wire material 30 is fed out to the curvature shaping unit 14 by driving of the conveyor roll 20. The coil wire material 30 fed to the curvature shaping unit 14 is made to penetrate between the first roll 32 and the second roll 34 as the shaping rolls, and the third roll 36 as the support roll.

The first movable table 40 and the third movable table 54 are appropriately moved by the drive mechanism 44 and the drive mechanism 62, respectively, to set a predetermined interval as the interval between the first roll 32 and the second roll 34 is set. In addition, the fourth movable table 86 is raised by a predetermined amount by the press mechanism 88. The first roll 32, the second roll 34, and the third roll 36 are respectively set at desired positions in accordance with the diameter of the coil spring to shape.

When the coil wire material 30 is pinched between the first roll 32, the second roll 34, and the third roll 36, the drive motors 24, 26, and 28 are then made to run. The first roll 32, the second roll 34, and the third roll 36 respectively connected to the motors are driven to rotate at a predetermined speed. In this manner, the coil wire material 30 is bent and formed at a desired curvature, as shown in FIG. 6. A tip end processing may be performed on the coil wire material 30 at the start of winding the material before bending the coil wire material 30 at the predetermined curvature.

When the coil wire material 30 is bent and the tip end thereof reaches the pitch tool 90, the drive mechanism of the pitch shaping unit 16 is then made operate to move to a front side of the baseboard 100, i.e., in a direction vertical to the paper surface of FIG. 1 (directions of arrow Y) in accordance with the desired pitch. In this manner, the coil wire material 30 is pressed in a screwing direction of the coil spring to shape as shown in FIG. 7, and a predetermined pitch is formed for the coil spring. Further, when a greater pitch is formed, the second roll 34 is operated. Hereinafter, operation of the second roll 34 will be described using FIG. 3 to FIG. 5.

FIGS. 3 to 5 schematically show the second roll 34, third roll 36, and pitch tool 90, supposing that the figures are viewed in the conveying direction from a near side along the conveying direction of the coil wire material 30. In FIG. 3, by moving the pitch tool 90 to the left side of the figure by the drive mechanism, the bent coil wire material 30 is pressed out to the left in relation to the second roll 34 and the third roll 36, thereby forming a pitch.

Further, to form a much greater pitch, the motor 61 of the drive mechanism 60 is run to move the third movable table 52 forth from the baseboard 100. The second roll 34 then moves to the left in relation to the conveying direction, as shown in FIG. 4. The position of the second roll 34 then shifts in relation to the conveying direction of the coil wire material 30 with respect to the third roll 36. In this manner, a deformation force can be applied to the coil wire material 30 in a direction of forming the pitch.

The motor 72 of the tilting mechanism 70 is run at this time. A lower part of the second roll 34 is tilted by a predetermined amount about the rotating support shaft 79 as a center, viewed from the near side in the conveying direction of the coil wire material 30. In this manner, the second roll 34 is tilted in the pitch shaping direction of the coil wire material 30. The coil wire material 30 is efficiently applied with a deformation force. The greater pitch can be smoothly formed for the coil spring.

On the other side, to reduce the pitch interval from that just been formed, the drive mechanism of the pitch tool 90 is operated in a direction opposite to the advance direction, to move back the pitch tool 90. In this manner, a force applied to the coil wire material 30 in the screwing direction is weakened, and the pitch interval is reduced.

If the amount of reduction of the pitch is great and if the coil wire material 30 does not follow back movement of the pitch tool 90, the drive mechanism 60 is operated and the third movable table 52 is moved back. The second roll 34 then moves up to the baseboard 100 and moves to the right in relation to the third roll 36, as shown in FIG. 5. Then, the interval in a pitch direction which has been created between the second roll 34 and the third roll 36 decreases, and a deformation force is applied from the second roll 34 in the direction of reducing the pitch.

At the same time, the motor 72 of the tilting mechanism 70 is run to cause rocking rotation of the rotating support shaft 79. The second roll 34 is tilted about the rotating support shaft 79 as a center in a manner that the lower end of the second roll 34 moves to the right when viewed from the near side in the conveying direction of the coil wire material 30.

In this manner, the second roll 34 is tilted in the direction of reducing the pitch of the coil wire material 30. The coil wire material 30 is efficiently applied with a deformation force by pinching with the third roll 36. Accordingly, the greater pitch can be smoothly formed for the coil spring. Therefore, a coil spring with a desired pitch can be formed regardless of whether the pitch is large or small.

In the foregoing examples, the pitch has been changed within a range of positive pitches. However, the coil-spring manufacturing apparatus 10 is not limited to the embodiment but a coil spring may be shaped to have a negative pitch. That is, the pitch of the coil spring may be sequentially changed from a positive pitch to a negative pitch or vice versa. When to form a pitch, shaping at the pitch may be performed only by movement of the pitch tool 90 without moving the second roll 34. When to reduce the pitch, the second roll 34 may be operated to tilt or move back.

In addition, the second roll 34 is desirably tilted about, as a center axis, a line which penetrates the roll center of the second roll 34 and penetrates the center of the second roll 34 in a thickness direction thereof. However, the center axis may be off of this line. When the tilting center of the second roll 34 is aligned with the line, movement of the lower end of the second roll 34 to the left and right and displacement thereof in the up and down directions can be reduced, as an effect.

The invention is not limited to the embodiment described above but can naturally be variously modified and practiced within a scope not deviating from the subject matters of the invention.

Applicability exists in use for a coil-spring manufacturing apparatus in which a coil wire material is bent by clamping among a plurality of rolls to manufacture a coil spring.

What is claimed is:

1. A coil-spring manufacturing apparatus comprising:

a first roll;

a second roll which is arranged on a same side as a side on which the first roll is arranged in relation to a conveying path for conveying a coil wire material and which is arranged downstream of the first roll in a conveying direction of the coil wire material;

a third roll which is arranged across the conveying path on a side opposed to the side on which the first roll and the second roll are arranged; and a pitch tool which moves back and forth along a screwing direction of a coil spring, wherein the coil spring is manufactured by bending the coil wire material at a predetermined curvature by the first roll, the second roll, and the third roll, and by shaping the bent coil wire material at a predetermined pitch, and wherein the second roll is movable back and forth along the screwing direction of the coil spring, and is tiltable about, as an axis of rotation, a line parallel to the conveying path of the coil wire material.

2. The coil-spring manufacturing apparatus according to claim 1, wherein the axis of rotation is set to penetrate through a roll center of the second roll.

3. The coil-spring manufacturing apparatus according to claim 1, wherein the second roll is movable back and forth along the screwing direction by a first rotary drive apparatus attached to the second roll, and the second roll is tiltable about, as the axis of rotation, the line parallel to the conveying path of the coil wire material by a second rotary drive apparatus attached to the second roll, and wherein operations of the first rotary drive apparatus and the second rotary drive apparatus are synchronized by a controller with an operation of the pitch tool to operate the bent and shaped coil wire material so that the bent and shaped coil wire material does not move apart from a surface of the pitch tool.

* * * * *